US005092702A

United States Patent [19]

Kurokawa

[11] Patent Number: 5,092,702

[45] Date of Patent: Mar. 3, 1992

[54] FLUID DISCHARGE DEVICE

[75] Inventor: Takumi Kurokawa, Soka, Japan

[73] Assignee: Pentel Kabushiki Kaisha, Tokyo, Japan

[21] Appl. No.: 601,730

[22] PCT Filed: Mar. 23, 1990

[86] PCT No.: PCT/JP90/00386

§ 371 Date: Oct. 23, 1990

§ 102(e) Date: Oct. 23, 1990

[87] PCT Pub. No.: WO90/11137

PCT Pub. Date: Oct. 4, 1990

[30] Foreign Application Priority Data

Mar. 28, 1989 [JP] Japan ..... 1-34895[U]
Jul. 4, 1989 [JP] Japan ..... 1-78985[U]

[51] Int. Cl.[5] ..... A46B 11/04

[52] U.S. Cl. ..... 401/279; 401/273; 401/278

[58] Field of Search ..... 401/278, 279, 273, 272

[56] References Cited

U.S. PATENT DOCUMENTS 371,899 10/1887 Osborne ..... 401/278 X
1,065,879 6/1913 Krebs ..... 401/272
1,138,772 5/1915 Matthews ..... 401/278 X
1,548,259 8/1925 Erikson ..... 401/278
3,589,824 6/1971 Andrews et al. ..... 401/279 X
3,682,559 8/1972 Hirota ..... 401/278
4,776,717 10/1988 Iizuka et al. ..... 401/279 X
5,007,757 4/1991 Iizuka ..... 401/278

FOREIGN PATENT DOCUMENTS 63-19171 5/1988 Japan .

*Primary Examiner*—Steven A. Bratlie
*Attorney, Agent, or Firm*—Wenderoth, Lind & Ponack

[57] ABSTRACT

A fluid discharge device includes a valve seat, a valve body biased rearwardly with respect to the valve seat and a pusher disposed at the back of the valve body so that it can be moved forwardly to open a valve against the biasing force when a forward push force is applied. The pusher is disposed inside a shaft body so that the push force is applied indirectly to the pusher through a fluid tank removably attached to the pusher. Outward protuberances are disposed on the outer wall of the pusher, recesses are formed on the inner wall of the shaft body, and the protuberances of the pusher are positioned in the recesses to limit the rotation of the pusher. The invention relates also to a fluid discharge member wherein, when a fluid is a liquid, the pusher is biased rearward in such a manner as to define a space between it and the valve body when no push force is applied, and an engagement portion with the pusher is disposed on the shaft body so as to limit the rearward displacement of the pusher.

18 Claims, 4 Drawing Sheets

FLUID DISCHARGE DEVICE

BACKGROUND OF THE INVENTION

The present invention relates to a fluid dispenser or a fluid discharge device which includes a valve seat, a valve body biased rearward with respect to the valve seat and a push member disposed at the back of the valve body so that it moves forward against the biasing force to the valve body and opens a valve when a forward push force is applied thereto, the push member being disposed inside a shaft body so that the push force described above is applied indirectly to the push member through a fluid tank fitted removably to the push member. Here, examples of the fluid include writing fluids such as bokuju or China ink (black writing fluids), paint and ink, cosmetic fluids such as eye liner, lip color, and nail color, solutions such as seasoning, machine oil and cleanser, or suitable powder.

Japanese Utility Model Publication 63-19171/1988 discloses an example of the fluid discharge device of the kind described above. This publication shows a writing instrument of the type which operates a valve body by the push operation of a knock rod to supply ink in an ink storage portion toward a pen body or a nib of the instrument. A cylindrical member is fitted into a shaft cylinder neck portion, a valve seat is formed at the front open portion of the cylindrical member and the valve body is brought into pressure contact and engaged with the valve seat from the front by a spring member. A leg portion of the valve body is loosely fitted into a through-hole of the cylindrical member, and faces and comes into contact with the front end of an ink cartridge member fitted loosely into a rear shaft cylinder. A flexible cylinder member is interposed in an air-tight manner between the cylindrical member and the ink cartridge member to connect them together, and a small space for extension and contraction of the flexible cylindrical member is formed between the shaft cylinder and the ink cartridge member for the purpose of allowing forward and rearward movement of the ink cartridge member by the operation of the knock rod at the tail end of the shaft cylinder.

In the fluid discharge device having such a valve structure, which uses a fluid tank fitted removably to the push member, the following problems which are not encountered in those fluid discharge devices having no valve structure arise.

A first problem is leakage of the fluid.

When the fluid tank is fitted to and removed from the push member, turning force is often applied. As one can understand more easily by imagining the case of fitting and removing of the cartridge of a fountain pen, many users feel that the operation becomes easier by fitting or removing the cartridge while applying the force of "twist". Needless to say, this turning force does not in most cases cause any problem in the case of ordinary fountain pens. In the case of the valve structure described above, however, the application of the turning force to the fluid tank might result in the unnecessary leakage of the fluid.

A second problem is variance or unacceptable differences in the feel of operation of the device. When a plurality of products are produced, the feel of operation varies from product to product.

A third problem is defects in handleability.

These problems will be explained further with reference to the drive disclosed in the aforementioned publication (63-19171/1988).

If the turning force is applied to the main body of the ink cartridge when fitting and removing the main body of the ink cartridge to and from a convex reduced diameter member, this turning force is transmitted to the convex reduced diameter member. Accordingly, the convex reduced diameter member attempts to rotate but since a flexible cylindrical member is fitted to this convex reduced diameter member and this flexible cylindrical member is fitted to a cylindrical member fitted into the shaft cylinder neck portion, the turning force of the convex cylindrical member produces the twist of the flexible cylindrical member. It is true that the flexible cylindrical member may exhibit some flexibility and such a twist might not generate breakage, but the twist force applies an excessive force to the fitting portion with the flexible cylindrical member or to the fitting portion with the flexible cylindrical member or to the fitting portion with the cylindrical member. As a result, even if the flexible cylindrical member is not broken, the first problem of ink leakage often occurs from these fitting portions.

The structure wherein the leg portion of the valve body faces the front end of the ink cartridge causes the second problem in that when a plurality of products are produced, the feel of operation differs remarkably from product to product. In order for the leg portion of the valve body to face and come into contact with the front end of the ink cartridge member fitted to the flexible cylindrical member while the valve body is brought into pressure contact and engaged with the valve seat by the spring member, dimensional design must be made so that the flexible cylindrical member is brought into a tension state where at least a light tension is applied to the flexible cylindrical member by the spring member when no pushing force is applied. However, existing dimensional variance must be considered. Therefore, when a plurality of products are produced, variance occurs in this tension.

Furthermore, the third problem of inferior handleability occurs from the fact that the main body of the cartridge will tend to become detached from the convex reduced diameter member. In other words, when the main body of the cartridge is removed from the convex reduced diameter member, a tension is further applied to the flexible cylindrical member besides the tension described above, and this results in breakage of the flexible cylindrical member, and the like. In this case, "fitting" might permit "removability" and might prevent the above-mentioned breakage of the flexible cylindrical member with reference to the cylindrical shaft neck portion, the cylindrical member, the flexible cylindrical member, the ink cartridge member or the convex reduced diameter member. In this case, however, "fitting" must be accomplished once again during fitting and removal between the ink cartridge and the convex reduced diameter member and this becomes troublesome. If fitting and removal between the ink cartridge and the convex reduced diameter member can be carried out with little force, the flexible cylindrical member might not become broken, but the problem of ink leakage will become worse.

SUMMARY OF THE INVENTION

It is an object of the present invention to solve the problems with the prior art technique described above and to provide a novel fluid discharge device for safely and reliably discharging a fluid.

It is another object of the present invention to provide a fluid discharge device which prevents as much as possible fluid leakage due to the application of excessive force when a fluid tank is assembled therein.

It is still another object of the present invention to provide a fluid discharge device having a reliable seal against ink leakage, and for which operational feel will remain the same even when a plurality of products are produced.

It is a further object of the present invention to provide a fluid discharge device which has excellent handleability and can be used reliably for a long period of time.

These and other objects of the present invention will become obvious from the following detailed description.

According to the present invention, there is provided a fluid discharge device comprising a valve seat, a valve body biased rearwardly with respect to the valve seat and a push member disposed at the back of the valve body in such a manner that it can be moved forwardly against a biasing force to open a valve when a forward push force is applied. The push member is disposed inside a shaft member so that the push force described above is applied indirectly to the push member through a fluid tank removably attached to the push member. The fluid discharge device further comprises outward protuberances on the outer wall of the push member, and recesses on the inner wall of the shaft member so that the protuberances of the push member are positioned in the recesses to limit rotation of the push member.

In another embodiment of the present invention, there is provided a fluid discharge device comprising a valve seat, a valve body biased rearwardly with respect to the valve seat and a push member disposed at the back of the valve body in such a manner that it can be moved forwardly against a biasing force to open a valve when a forward push force is applied. The push member is disposed inside a shaft member so that the push force described above is applied indirectly to the push member through a fluid tank removably attached to the push member. The fluid discharge device comprises further means for rearwardly biasing the push member so as to define a space relative to the valve body when the push force described above is not applied, and an engagement portion on the shaft member for engaging with the push member so as to limit rearward displacement of the push member.

BRIEF DESCRIPTION OF THE DRAWING

FIGS. 2 through 13 show respective components shown in FIG. 1, wherein:

FIG. 2 is a partially cut-away longitudinal sectional view of a tubular member;

FIG. 3 is a partially cut-away longitudinal sectional view of a tip shaft;

FIG. 4 is a perspective view of a valve body;

FIG. 5 is a bottom view of the valve body shown in FIG. 4;

FIG. 6 is a partially cut-away longitudinal sectional view of bellows;

FIG. 7 is a partially cut-away longitudinal sectional view of a pusher;

FIG. 8 is a transverse sectional view taken along line VIII—VIII of the pusher shown in FIG. 7;

FIG. 9 is a longitudinal sectional view of a front shaft;

FIG. 10 is a transverse sectional view taken along line X—X of the front shaft shown in FIG. 9;

FIG. 11 is a transverse sectional view taken along line XI—XI of the front shaft shown in FIG. 9;

FIG. 12 is a partially cut-away longitudinal sectional view of an inner shaft; and FIG. 13 is a transverse sectional view taken along line XIII—XIII of the inner shaft shown in FIG. 12.

PREFERRED EMBODIMENTS OF THE INVENTION

Figure 1:
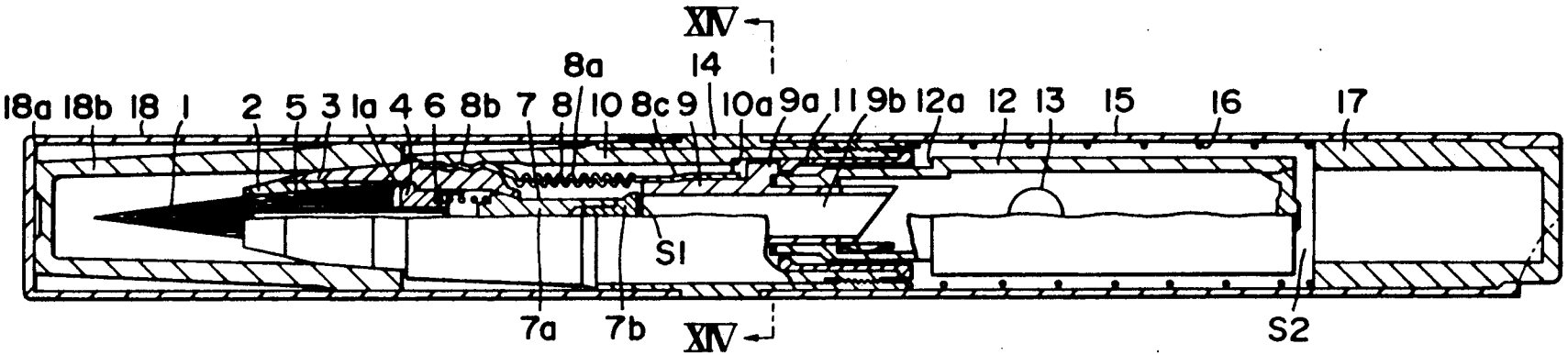
FIG. 1 is a partially cut-away longitudinal sectional view showing an example of the fluid discharge device in accordance with the present invention.

Referring first to FIG. 1 which shows an embodiment of the fluid discharge device, the main body of the fluid discharge device comprises a brush 1 as a nib or a pen body, a tubular member 2, a tip shaft 3, a stopper 4, a pipe 5, a resilient member 6, a valve body 7, a bellows 8, a pusher 9, a front shaft 10, an inner shaft 11, a fluid tank 12, a ball 13, a connection shaft 14, a rear shaft 15, a resilient member 16 and a knock button 17. A cap 18, consisting of an outer cap **18*a* and an inner cap 18*b***, is mounted on the main body.

In other words, the drawing illustrates an example of a painting device, and mutual relations between these members will be explained below.

The brush 1 has a flange-like rear end portion **1*a*. It stores a bundle of suitable natural of synthetic brush hairs. If a thermoplastic synthetic resin fiber is used for the brush, for example, a heated sheet is brought into contact and fused with the rear end of the bundled fiber so that the bundle and the sheet are integrated and the flange-like rear end portion 1*a* has a portion expanding in flange-like form. This brush 1 is prevented from becoming detached by the tubular member 2**.

Figure 2:
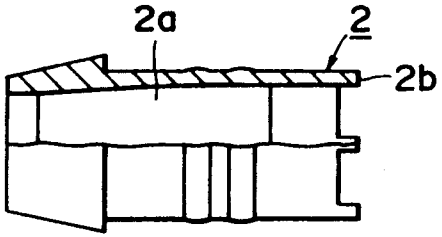

The tubular member 2 has a center hole **2*a* having an intermediate portion whose diameter becomes somewhat reduced towards a forward end of the tubular member 2, and a protuberance 2*b* at a rear end of the tubular member 2 (see FIG. 2). The brush 1 is fitted from the rear end of the center hole 2*e*. The protuberance 2*b* comes into contact with the front surface of the flangelike rear end portion of the brush 1. The protuberance 2*b* can itself be easily deformed, or can easily cause deformation of the portion at the rear end portion 1*b* of the brush 1, with which the protuberance 2*b* comes into contact, so that in the event of any variance in the dimensions of components (e.g. dimensional variance of the thickness of the flange-like rear end portion 1*b* in the longitudinal direction), such variance is compensated for, such that the brush 1 is securely fixed in place. The tubular member 2 is fitted in the tip shaft 3 by a press-fit or the like. Although four protuberances 2*b* are shown in the drawing, the number and shape of the protuberances 2*b*** are arbitrary.

Figure 3:
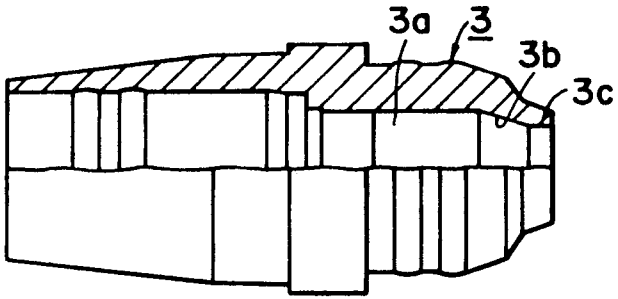

The tip shaft 3 has a center hole **3*a* whose diameter becomes progressively smaller toward the rear end portion 3*c* (see FIG. 3). A taper portion 3*b* is formed at the rearmost portion of the center hole 3*a***, and is adapted to contact and form a seal with the valve body 7. In other words, a rear end portion 3c of the tip shaft 3 is a portion of the valve seat. The stopper 4 is anchored in the center hole 3a. The pipe member 5 extending inside the brush 1 is fitted to this stopper 4 and the stopper 4 supports the rear end of the brush 1. Namely, the brush 1 is clamped between the tubular member 2 and the stopper 4 at its rear end portion 1a.

The rear wall of the stopper 4 provides a support portion for the resilient member 6 which, in the preferred embodiment is a coil spring 6. The rear end of the coil spring 6 is anchored to the valve body 7 and biases it rearward.

Figure 4:
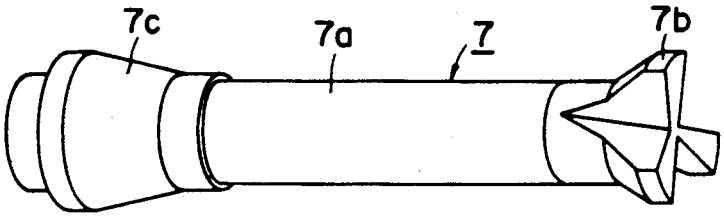
Figure 5:
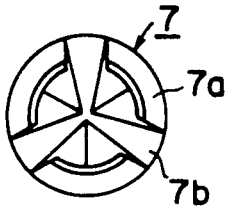

The valve body 7 consists of a front member 7a and a rear member 7b (see FIG. 4). The front member 7a has a taper wall portion 7c whose diameter decreases progressively in the rearward direction. The taper wall portion 7c comes into contact with the taper portion 3b of the center hole 3a and establishes the valve closing state shown in FIG. 1. The degrees of taper of the taper wall portion 7c and taper portion 3b (i.e. the degree of decrease of the respective diameter in the rearward direction) are such that the degree of taper of the taper wall portion 7c is less than that of the taper portion 3b. In other words, the design is such that the periphery of the rear end of the taper portion 3b of the center hole 3a of the tip shaft 3 moves linearly into contact with the surface of the taper wall portion 7c due to variance of the dimensions of components. The rear member 7b has an odd-shaped cross-section (see FIG. 5), as will be described.

Figure 6:
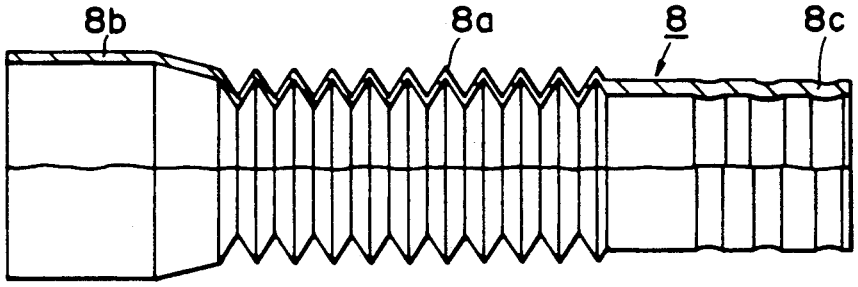

The bellow 8 is disposed outside the valve body 7. The bellows 8 has a flexible intermediate portion 8a capable of extending, contracting and deforming (see FIG. 6). A tip portion 8b of the bellows 8 is fitted onto the tip shaft 3 by press-fitting or the like, and similarly a rear end portion 8c of the bellows 8 is press-fitted onto the pusher 9.

Figure 7:
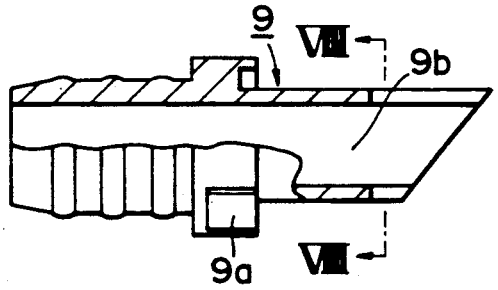
Figure 8:
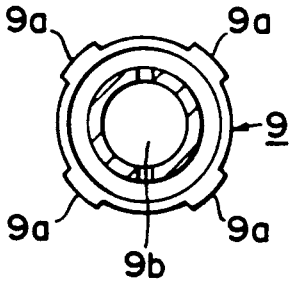

As shown in FIGS. 7 and 8, the pusher 9 has protuberances 9a and a center hole 9b. Though four protuberances are shown in the drawings, any suitable number of protuberances can be utilized. The through-hole 9b defines a passage for a fluid.

The components ranging from the brush 1 in the frontmost position to the pusher 9 in a rearward position are assembled in advance as a pre-assembly before they are assembled into the state shown in FIG. 1. (Hereinafter this pre-assembly will be referred to as a "nib assembly").

Figure 9:
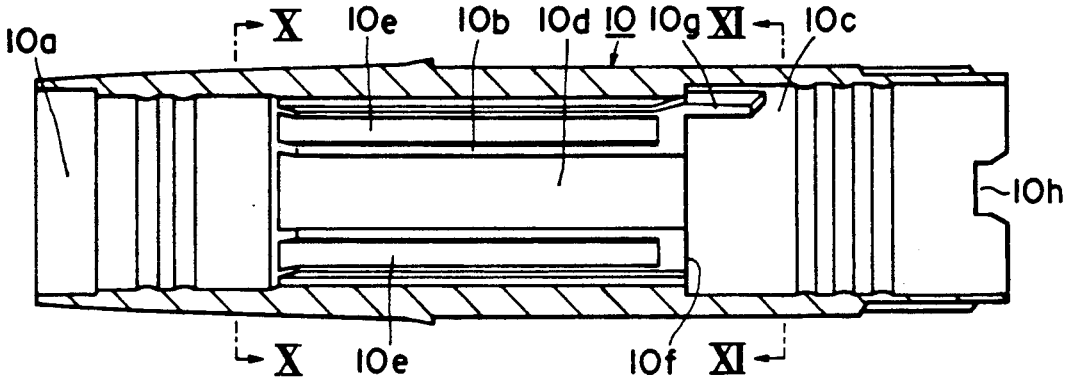
Figure 10:
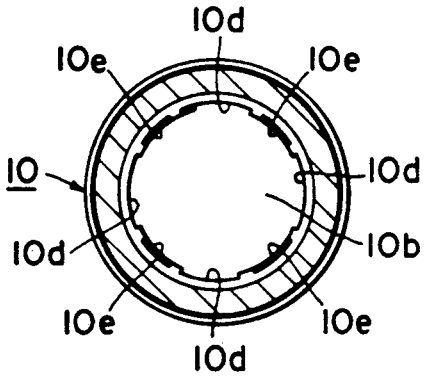
Figure 11:
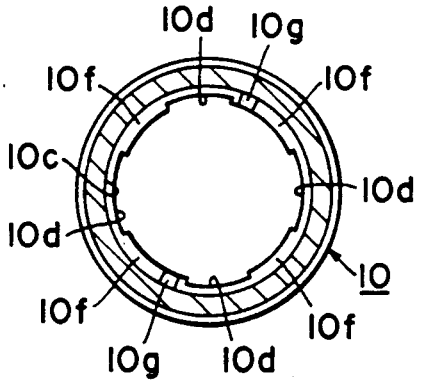

The nib assembly is fitted into the front shaft 10 from behind, and the tip 3 of the nib assembly projects from, and is fixed to, the front shaft 10, such that the tip portion 8b of the bellows 8 is clamped between the front shaft 10 and the tip 3. The inner shaft 11 is press-fitted into the rear end of the front shaft 10. In the state shown in FIG. 1, the pusher 9 is in contact with the inner shaft 11 and the bellows 8 is somewhat contracted with respect to its normal length. However, the pusher 9 is out of contact with the rear end of the rear member 7b of the valve body 7, such that a space S1 is defined between them. The front shaft 10 has an inner hole 10a whose intermediate portion has a small diameter portion 10b and whose rear portion has a large diameter portion 10c. A plurality of recess passages 10d extending longitudinally to the large diameter portion 10c are formed in the small diameter portion 10b (see FIGS. 9 through 11). The recess passages 10d serve as passages for the protuberances 9a of the pusher 9. Though the passage shown in the drawings has a structure wherein the bottoms of the recess passages 10d form steps with respect to the large diameter portion 10c, it is arbitrary and hence, the step can be omitted. A plurality of recess portions 10e are disposed along the recess passages 10d in the small diameter portion 10b of the inner hole 10a. The use of an injection molded article of synthetic resin is assumed for the front shaft 10 so that the thickness of the molded articles is made as uniform as possible in order to attain a desirable resin flow at the time of molding. Accordingly, steps 10f are formed at the boundaries between the small diameter portion 10b and the large diameter portion 10c of the inner hole 10a, except at the locations of the recess passages 10d. Projection portions 10g projecting rearwardly from the steps 10f are formed in the large diameter portion 10c of the inner hole 10a. In other words, after the elements of the nib assembly are assembled, the protuberances 9a of the pusher 9 pass through the inner hole 10a of the front shaft 10 from the front, through the recess passages 10d of the smaller diameter portion 10b, and reach the large diameter portion 10c. When the nib assembly is rotated thereafter (clockwise with respect to the front shaft 10 when viewed from the front side of the front shaft 10 in this embodiment), rotation of the protuberances 9a of the pusher 9 is restricted because they strike the projection portions 10g formed in the large diameter portion 10c. Accordingly, positioning of the protuberances 9a of the pusher 9 to a predetermined position is confirmed by sensing this contact, and the nib assembly is fixed to the front shaft 10. (Since the front shaft 10 is not always transparent, the physical contact or touch is often used for confirmation.) In this manner, the protuberances 9a of the pusher 9 are positioned at the back of the steps 10f between the small diameter portion 10b and the large diameter portion 10c of the inner hole 10.

Figure 12:
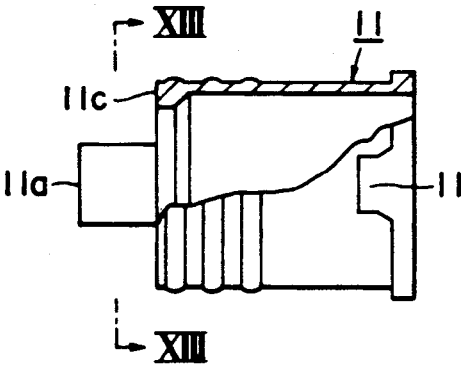
Figure 13:
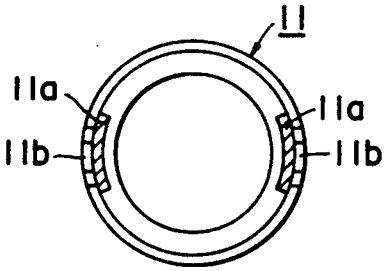
Figure 14:
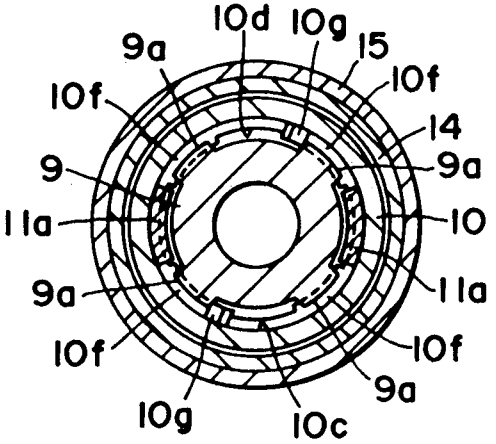
FIG. 14 is a transverse sectional view taken along line XIV—XIV of the fluid discharge device shown in FIG. 1.

Furthermore, the inner shaft 11 is assembled with the pre-assembly as follows. The inner shaft 11 has protuberances 11a at its tip and a pair of odd-shaped portions 11b at an outside surface of its rear end (see FIGS. 12 and 13). The odd-shaped portions 11b fit into notches 10h which are formed at the rear end of the front shaft 10. In other words, the inner shaft 11 is assembled with the front shaft 10 in a predetermined positional relationship. Due to this relationship, when the protuberances 11a of the inner shaft 11 are positioned relative to the large diameter portion 10c of the inner hole 10a of the front shaft 10, they are positioned on both sides of a protuberance 9a of the pusher 9 along with the projection portion 10g of the front shaft 10. When the inner shaft 11 is fitted into the front shaft 10, a projection base portion 11c of each protuberance 11a of the inner shaft 11 pushes the protuberance 9a of the pusher somewhat forward and causes its displacement. After the protuberances 9a of the pusher are set in this manner, each of the protuberances 9a is flanked on one side by the projection portion 10g for restricting rotation and on the other side the protuberance 11a. In addition, the front of each protuberance 9a is abuttable with the step portion 10f for restricting advance and the rear of each protuberance is abuttable with, the projection base portion 11c for limiting retreat. The protuberances 9a are "outward protuberances" in this embodiment, and a "recess" is formed in this embodiment by the protuberance 10g, the protuberance 11a, the step portion 10f and the projection base portion 11c. (The assembly of the components ranging from the brush 1 to the inner shaft 11 described above will be hereinafter referred to as the "front shaft assembly").

The fluid tank 12 is removably fitted into the rear part of the pusher 9 assembled as part of the front shaft assembly. The fluid tank 12 shown in the drawing incorporates a ball 13 in it. This ball 13 is used for stirring the fluid in the fluid tank 12. In other words, this embodiment represents an example where a solution such as a cosmetic solution is stored in the fluid tank 12. When the fluid tank 12 is fitted into the pusher 9, the pusher 9 advances until it comes into contact with the steps 10*f* of the front shaft 10. In this state, the fluid tank 12 further advances in the direction of the pusher 9. If application of the force for pushing the liquid tank 12 in the direction of the pusher 9 is continued without restriction at this time, the pusher 9 might be broken. In this embodiment, therefore, the rear end wall of the inner shaft 11 stops the advance of the fluid tank 12. In FIG. 1, the front end of the fluid tank 12 is shown out of contact from the pusher 9 for this reason.

Here, when the fluid tank 12 is fitted into the pusher 9, the rotation is restricted, and advance and retreat of the pusher 9 are also restricted. Moreover, the nib assembly of the front shaft assembly is inserted from the front portion of the front shaft 10. These relations are satisfied by the pusher 9, the front shaft 10 and the inner shaft 11.

The connection shaft 14 is fitted into the tip portion of the rear shaft 15 by press-fit or the like, and its rear end wall serves as the support portion for the resilient member 16 which, in the preferred embodiment, is a coil spring 16. The coil spring 16 biases the knock button 17 rearwardly, and the knock button 17 is prevented from becoming detached due to its engagement with the rear end reduced diameter portion of the rear shaft 15. Part of the rear end portion of the knock button is exposed from the notch-like portion of the rear end of the rear shaft 15. The knock button 17 has a space S2 between it and the fluid tank 12. (The assembly of the components ranging from the connection shaft 14 to the knock button 17 will be hereinafter referred to as the "rear shaft assembly".)

The front shaft assembly and the rear shaft assembly are removably fitted together. This fitting may be attained by a press-fit or the like, but in this embodiment, a screw portion is formed between the front shaft 10 and the connection shaft 14 to provide a threaded engagement.

Accordingly, when the device of this embodiment is used, the screw engagement between the front shaft assembly and the rear shaft assembly is released, the fluid tank 12 is then fitted onto the pusher 9, and the front shaft assembly and the rear shaft assembly are meshed with each other under in the manner shown in FIG. 1. When a push force is applied to the knock button 17, the knock button 17 advances a little and comes into contact with the rear end of the fluid tank 12, at which time the pusher 9 start moving forward.

When the knock button 17 is advanced a little further, the push member 9 comes into contact with the valve body 7. Accordingly, the valve body 7 advances to open the valve and the fluid is delivered to the brush 1 for painting or coating. At this time the space S1 separates the rearward biasing force applied to the pusher 9 by the bellows 8 from the other rearward biasing force applied to the valve body 7 by the spring 6. Thus, the rearward biasing force against the pusher 9 is not affected by the rearward biasing force against the valve body 7, so that the biasing force against the pusher 9 can, accordingly, be the biasing force by the bellows 8 against the pusher 9 at "zero" in the state shown in FIG. 1 when no push force is applied to the knock button 17 (i.e. where the bellows 8 is extended completely), or to set it to a certain set value as described already. Accordingly, even when a plurality of products are produced, the operational feel for each is the same as for the rest.

Since the pusher 9 has the space S1 between it and the valve body 7, the space S1 can prevent unnecessary valve opening. In other words, even when the fluid tank 12 is about to move forth due to the force of inertia of the fluid or the fluid tank 12 itself resulting from the impact during transportation or by the impact of the ball 13 against the fluid tank 12, the presence of the space S1 prevents the abrupt advance of the valve body 7. Furthermore, unnecessary valve openings are likewise prevented by the presence of the space S2 between the knock button 17 and the fluid tank 12, as well as by the exposure of only part of the rear end portion of the knock button 17 from notch-like portion at the rear end of the rear shaft 15.

Since the engagement portion of the projection base portion 11*c* for limiting the rearward displacement distance of the pusher 9 is disposed in the inner shaft 11, the pusher 9 and the bellows 8 are not pulled excessively when the fluid tank 12 is removed from the pusher 9. Needless to say, the anchor of the pusher 9 by the engagement portion need only be used when the fluid tank is removed, and thus handleability becomes excellent, and the device can provide stable use for a long period of time.

Since the rear member 7*b* of the valve body 7 has an odd-shaped cross-section, the center hole 9*b* of the pusher 9, which acts as the fluid passage, and the interior of the bellows 8 remain in communication with each other even when the pusher 9 comes into contact with the valve body 7. If contact between the valve body 7 and the pusher 9 were too close the through-hole 9*b* of the pusher 9, the volume change of its front space would result in positive fluid pressurization and air introduction. Such an arrangement may be preferable in some cases, but not in others, depending on the kind of fluids utilized. In this embodiment, it is desired to prevent such a pressurization as much as possible. When the present device is used as a painting device for painting with a liquid, as in this embodiment, it is best to set the maximum quantity of volume contraction of the fluid containment portion to the rear of the valve portions (i.e. the portion formed by the fluid tank 12, the center hole 9*b* of the push member 9 and the interior of the bellows 8, in this embodiment) greater than the volume of the space in front of the valve (i.e. the space in which the coil spring 6 is disposed and where the center hole of the pipe 5 is formed, in this embodiment), but smaller than the maximum fluid quantity which the painting tip (the brush 1, in this embodiment) can hold. In this embodiment, the maximum quantity of volume contraction of the fluid containment portion is defined by the position of the steps 10*f* of the front shaft 10 which limits movement of the pusher 9. Such restrictions on the volume contraction can eliminate the discharge of fluid droplets caused by an excessive push force when the fluid is discharged by the push operation. In addition, the trouble of repeating the push operation several times in order to render the device usable after periods of non-use can be avoided.

As described above, this embodiment represents an example of the device for which not only the rotation of the pusher 9 but also its advance and retreat are restricted, and for which a desired assembly efficiency is provided.

Next, another embodiment of the fluid discharge device will be explained with reference to FIG. 15. The same reference numerals will be used to identify essentially the same portions as described above.

Figure 15:
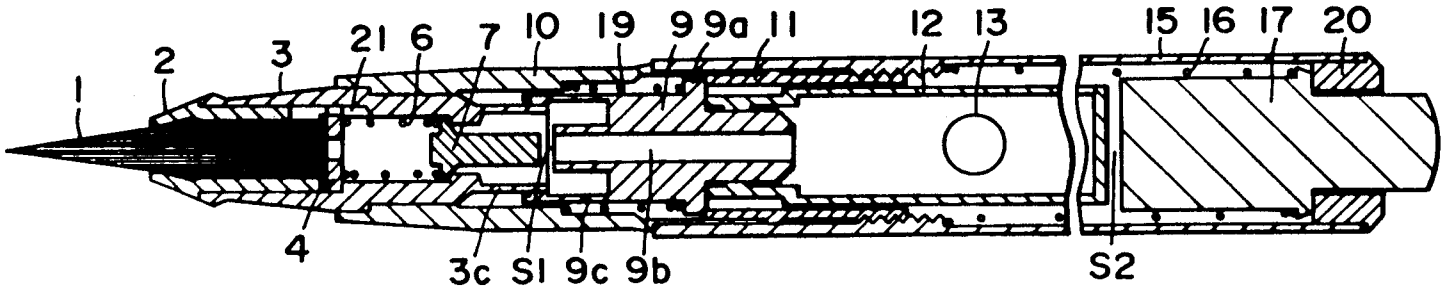
FIG. 15 is a partial longitudinal sectional view showing another embodiment of the fluid discharge device in accordance with the present invention.

The difference between this embodiment and the foregoing embodiment lies in that the bellows 8 is not used in the embodiment of FIG. 15. Instead, the rear end portion 3*c* of the tip shaft 3 is extended rearwardly so as to function as a piston, the tip portion 9*c* of the pusher 9 is extended forwardly so as to function as a cylinder within which the piston (i.e. tip shaft 3) slides, and a resilient member such as a coil spring 19 is used for biasing the pusher 9 rearwardly. Here, the piston and cylinder can rotate relative to one another. However, such relative rotation often results in fluid leakage. It is therefore desirable to limit the rotation.

Another difference in the embodiment of FIG. 15 relative to the first embodiment of FIGS. 1–14 lies in that the components are suitably integrated, omitted or work as a plurality of components. For example, the valve body 7 consists of one member, and, rather than utilizing a connection shaft such as 14 in the first embodiment, the rear shaft 15 performs the function of the connection shaft 14. As to the disposition of the coil spring 16, a tail crown 20 is fitted into the rear end of the rear shaft 15. Rather than utilizing a pipe, such as 5 in the first embodiment, the stopper 4 itself supports the brush 1. In addition, an air passage 21 is formed by disposing a notch in this stopper 4, or the like.

One of the differences other than those described above lies in that certain components are formed in other suitable shapes. For example, the shape of the knock button 17 is different as shown in the drawing. The shape of the rear shaft 15 is also different, so that the projecting state of the knock button 17 is different as well.

Besides the differences described above, various changes and modifications can be suitably made without departing from the spirit of the invention, even through an explanation with reference to the drawings is omitted. For example, another resilient member or a spring can be used if the resilience of the bellows 8 is not itself sufficient. If the protuberances 9*a* of the pusher 9 are made expansible, the painting tip set can be fitted into the front of the front shaft 10 without forming the recess passages 10*d* in the inner hole 10*a* of the front shaft 10 and, moreover, advancement can be restricted. Further, the fluid tank 12 may use the ball 13 as its plug, or may not have the ball 13. The fluid tank 12 can itself project from the rear end of the rear shaft without using the knock button 17, and if necessary, the bellows 8 and the pusher 9 may be molded as a unitary structure. This also holds true of other elements. Also, the engagement portion can be disposed in other components of the shaft member rather than in the inner shaft 11. Furthermore, though the foregoing embodiments represent examples of the painting device having a brush, they can be applied to a writing instrument equipped with a pen tip or a predetermined writing nib, which is obtained by extrusion molding of a synthetic resin and is ordinarily referred to as a "resin pen", or a felt pen, or a device having merely an open end such as ordinary oilers for machinery. Furthermore, the device is not limited to a type wherein the projection portion from the rear end is pushed but can be of any type where a suitable portion is pushed in a suitable direction.

What is claimed is:

1. A fluid discharge device comprising:

a discharge tip;

a fluid tank located rearwardly of said discharge tip;

a fluid passage between said fluid tank and said discharge tip;

a valve means for opening and closing said fluid passage, said valve means comprising a valve seat, and a valve body movable between a closed position in which it is engaged with said valve seat and an open position in which it is spaced forwardly from said valve seat;

first biasing means for resiliently biasing said valve body rearwardly into its closed position;

a push member mounted rearwardly of and adjacent to said valve body, and having an axial hole formed therethrough which defines a first part of said fluid passage, said push member being movable between a forward position in which it abuts said valve body and a rearward position in which it is spaced rearwardly from said valve body, and said push member defining a means for pushing said valve body forwardly against a biasing force of said first biasing means and into said open position; and second biasing means for resiliently biasing said push member rearwardly into said rearward position in which said push member is spaced rearwardly from said valve body.

2. A fluid discharge device as recited in claim 11, wherein said second biasing means comprises an elongated longitudinally resilient tubular member having a rear end connected to a forward end of said push member; and said elongated resilient tubular member defines a second part of said fluid passage.

3. A fluid discharge device as recited in claim 2, wherein said fluid tank is releasably engaged with a rear end of said push member and defines a means for pushing said push member forwardly.

4. A fluid discharge device as recited in claim 3, wherein said push member includes a protuberance protruding outwardly from an outer surface of said push member; and a tubular shaft is mounted about said push member and has a recess means formed therein for engaging said protuberance of said push member and limiting rotation of said push member.

5. A fluid discharge device as recited in claim 4, wherein said resilient tubular member comprises a bellows.

6. A fluid discharge device as recited in claim 5, further comprising means for contacting said protuberance of said push member as said push member moves rearwardly to a predetermined rearward position so as to limit rearward movement of said push member.

7. A fluid discharge device as recited in claim 6, further comprising means for contacting said protuberance of said push member as said push member moves forwardly to a predetermined forward position so as to limit forward movement of said push member.

8. A fluid discharge device as recited in claim 4, further comprising means for contacting said protuberance of said push member as said push member moves rearwardly to a predetermined rearward position so as to limit rearward movement of said push member.

9. A fluid discharge device as recited in claim 8, further comprising means for contacting said protuberance of said push member as said push member moves forwardly to a predetermined forward position so as to limit forward movement of said push member.

10. A fluid discharge device as recited in claim 3, wherein said push member includes a protuberance protruding outwardly from an outer surface of said push member; and means for contacting said protuberance of said push member as said push member moves rearwardly to a predetermined rearward position so as to limit rearward movement of said push member.

11. A fluid discharge device as recited in claim 10, further comprising means for contacting said protuberance of said push member as said push member moves forwardly to a predetermined forward position so as to limit forward movement of said push member.

12. A fluid discharge device as recited in claim 2, wherein said push member includes a protuberance protruding outwardly from an outer surface of said push member; and means for contacting said protuberance of said push member as said push member moves rearwardly to a predetermined rearward position so as to limit rearward movement of said push member.

13. A fluid discharge device as recited in claim 12, further comprising means for contacting said protuberance of said push member as said push member moves forwardly to a predetermined forward position so as to limit forward movement of said push member.

14. A fluid discharge device as recited in claim 2, wherein said push member includes a protuberance protruding outwardly from an outer surface of said push member; and a tubular shaft is mounted about said push member and has a recess means formed therein for engaging said protuberance of said push member and limiting rotation of said push member.

15. A fluid discharge device as recited in claim 2, wherein said resilient tubular member comprises a bellows.

16. A fluid discharge device as recited in claim 1, wherein said fluid tank is releasably engaged with a rear end of said push member and defines a means for pushing said push member forwardly.

17. A fluid discharge device as recited in claim 11, wherein said push member includes a protuberance protruding outwardly from an outer surface of said push member; and a tubular shaft is mounted about said push member and has a recess means formed therein for engaging said protuberance of said push member and limiting rotation of said push member.

18. A fluid discharge device as recited in claim 11, wherein said push member includes a protuberance protruding outwardly from an outer surface of said push member; and means for contacting said protuberance of said push member as said push member moves rearwardly to a predetermined rearward position so as to limit rearward movement of said push member.

* * * * *